US007568814B2

(12) United States Patent
Yichun

(10) Patent No.: US 7,568,814 B2
(45) Date of Patent: Aug. 4, 2009

(54) ELECTRICAL TORCH

(76) Inventor: Liao Yichun, Flat D. Block 4, 26/F., Metro City Phase 2, 8 Yan King Road, Tseung Kwan O, Kowloon, Hong Kong (CN)

( * ) Notice: Subject to any disclaimer, the term of this patent is extended or adjusted under 35 U.S.C. 154(b) by 601 days.

(21) Appl. No.: 11/422,880

(22) Filed: Jun. 8, 2006

(65) Prior Publication Data

US 2007/0285025 A1 Dec. 13, 2007

(51) Int. Cl.
*F21L 17/00* (2006.01)

(52) U.S. Cl. ..... 362/206; 362/202; 362/208

(58) Field of Classification Search ..... 362/202, 362/206, 208, 205, 157
See application file for complete search history.

(56) References Cited

U.S. PATENT DOCUMENTS 6,296,367 B1 * 10/2001 Parsons et al. ..... 362/183
6,388,390 B2 * 5/2002 Rachwal ..... 315/200 R
2005/0002186 A1 * 1/2005 Krieger et al. ..... 362/183
2005/0099805 A1 * 5/2005 Chapman ..... 362/184

* cited by examiner

*Primary Examiner*—Laura Tso
(74) *Attorney, Agent, or Firm*—Michael Diaz

(57) ABSTRACT

A new and practical electrical torch. The electrical torch includes a canister, a beam cover connected to one end of the canister and a base connected to another end of the canister. The illumination device is installed in the beam cover. It is connected with a positive pole of the power supply. The electric switch is connected to a power supply in the canister. The electric switch includes a single-chip, N channeling MOST (metal oxide semiconductor transistor) and a diode connected in turn. Furthermore, the diode is serially connected with one discharge resistance and energy-saving discharge capacitance. An output pin of the single-chip is connected to a touch switch. The other end of the touch switch is grounded. Moreover, one end of a pull-low resistance is connected to the output pin of the single-chip. The other end of the resistance is grounded. Therefore, this type of electrical torch provides both lighting and may also transmit a warning signal.

3 Claims, 3 Drawing Sheets

ELECTRICAL TORCH

BACKGROUND OF THE INVENTION

1. Field of the Invention

This invention relates to a practical and new lighting apparatus. Specifically, and not by way of limitation, the present invention relates to an electrical torch for lighting and warning.

2. Description of the Related Art

The traditional electric torch or flashlight includes one canister containing a dry battery, a control switch fixed on a canister, a lighting lamp and a base. The control switch is mechanical. A slide key is set on the canister, which is connected with one piece of a chip. It can be switched on or off by regulating the position of the slide key. Specifically, as the chip is connected with a loop of power supply, the electric torch turns on and illuminates. In reverse, it turns off. Therefore, such electric torches can only provide lighting. Furthermore, the mechanical switch is easy to get abraded, which results in poor contact so that the torch is inoperative. In this case, it is necessary to improve such traditional torches so as to satisfy demands of users. It is an object of the present invention to provide such an apparatus.

SUMMARY OF THE INVENTION

This invention improves upon the above described shortcomings of an electrical torch. The present invention provides an electric torch that provides lighting and also transmits a warning signal and provides easy operation. In order to realize the above said purpose, this invention provides the following technical scheme: an electrical torch comprising a canister, a power supply fixed in the canister, a beam cover connecting with one end of the canister and a base connecting to another end of the canister; wherein the illumination device is installed in the beam cover. It is connected with a positive pole of the power supply. Above the base is connected an electric switch connecting to the power supply canister. This electric switch is comprised by a single-chip, N channeling MOST (metal oxide semiconductor transistor) and a diode connected in turn. The output pin of the single of the single-chip is connected with a control pin of the N channeling MOST. An output pin of the N channeling MOST is then connected with the positive pole of the diode. The positive pole of the diode connects what the negative pole of the illumination device. Furthermore, the negative pole of the diode is serially connected with one discharge resistance and energy-saving discharge capacitance. The positive pole of the energy-saving discharge capacitance connects with the output pin of the single-chip where a touch switch is also connected. The other end of this touch switch is grounded. Moreover, the output pin of the above described single-chip connects to one end of the pull-low resistance while the other end is grounded. The electrical switch is installed at the bottom of the base, through a hole. A seal cover is set at the bottom of this base.

The illumination device is comprised by a lamp holder, an illuminant fixed upon a lamp holder panel, a reflection cup connecting to the base, and a beam lens fixed at the top of the reflection cup. Positive and negative poles are connected to the illuminant and are set on the base of the lamp holder. The positive pole of the illuminant is connected with the positive pole of the power supply. The negative pole of it is connected with the electric switch via the canister. The electric switch connects to the negative pole of power supply.

There are several advantages of the electrical torch. The electric switch is fixed at the bottom of the base and is composed of a single-chip. N channeling MOST and diode connected in turn. An output pin of the single-chip is connected with the control pin of the N channeling MOST, and the control pin of the N channeling MOST (metal oxide semiconductor transistor) is connected to the positive pole of the diode. The positive pole of the diode connects with the negative pole of the illumination device. The negative pole of the diode is serially connected with one discharge resistance and energy saving discharge capacitance. The positive pole of the energy-saving discharge capacitance connects to the output pin of the single-chip. Furthermore, the output pin of the single-chip is connected to the touch switch, and another end of this touch switch is grounded. The user presses the touch switch, which then switches the diode on. The illuminant may then emit light. If the touch switch is pressed for a few seconds, the single-chip may be switched over between high and low level, so that the N channeling MOST connecting with the single-chip can output a touch signal to the control switchover of the diode in the on/off switch. The illuminant may then flash continuously. This type of electrical torch can not only give lighting, but also transmit a warning signal.

DESCRIPTION OF THE INVENTION

Figure 1:
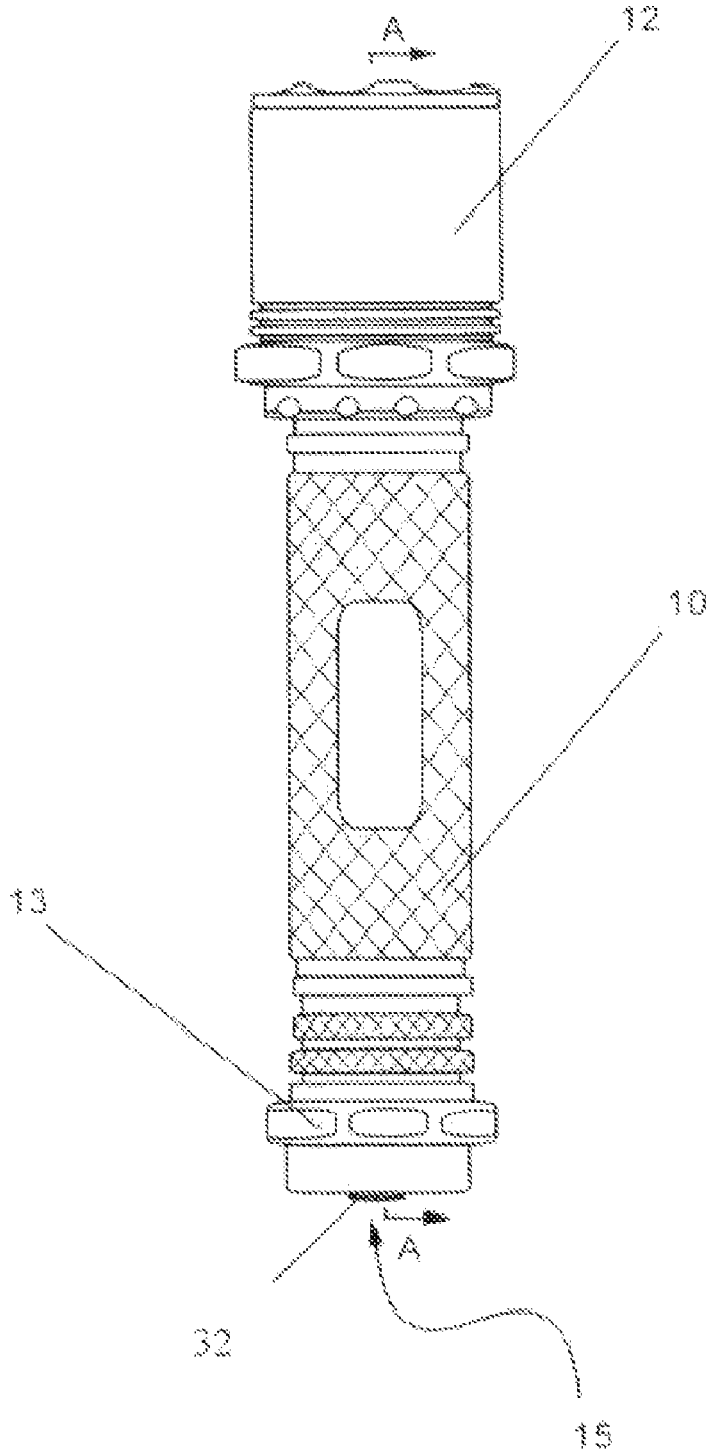
FIG. 1 is a front view of the practical and new electrical torch.

The following is a description of the reference numbers.

Canister 10
Power supply 11
Beam cover 12
Base 13
Illumination device 14
Electric switch 15
Single-chip 16
N channeling MOST 17
Diode 18
Discharge resistance 19
Energy-saving discharge capacitance 20
Touch switch 21
Resistance 22
Lamp holder 23
Illuminant 24
Positive/negative pole 25, 26
Spring 27
PCB 28
Reflecting cup 29
Beam lens 30
baffle 31
Seal cover 32

Figure 2:
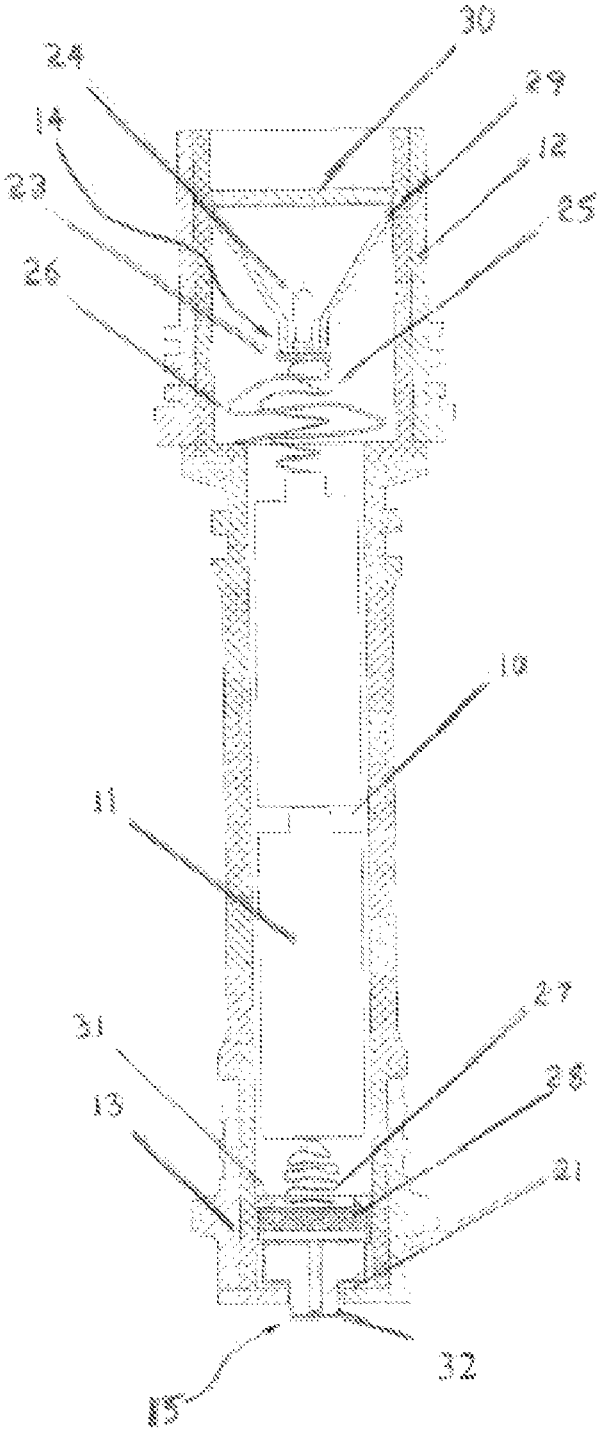
FIG. 2 is a sectional view of FIG. 1.
Figure 3:
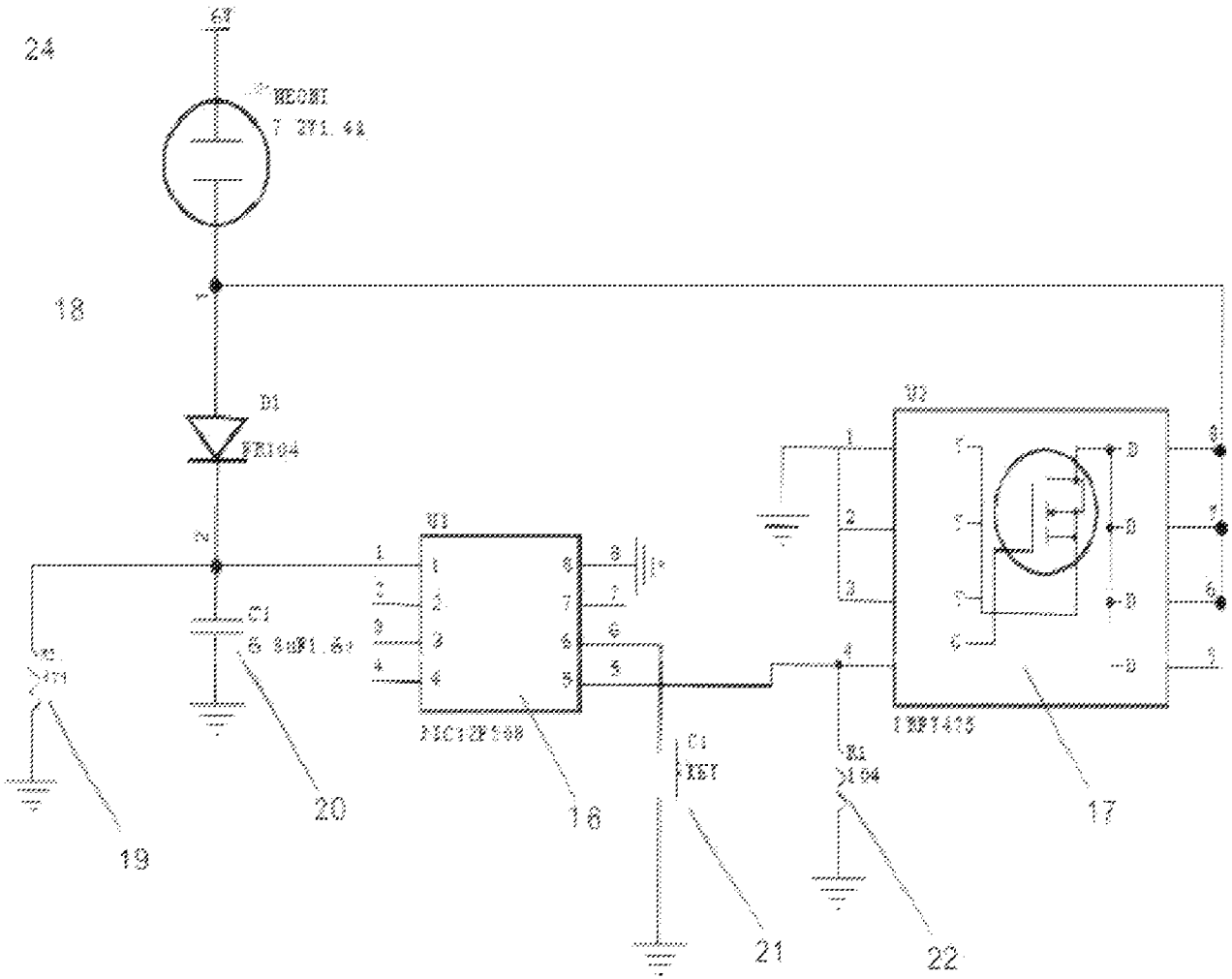
FIG. 3 is the circuit diagram of the electrical torch.

Referring to FIGS. 1-3, an electrical torch comprises a canister 10, a power supply 11 fixed in the canister 10, a beam cover 12 connecting with one end of the canister 10 and the base 13 connecting to another end of the canister 10. The illumination device 14 is installed in the beam cover 12. It is connected with a positive pole to a power supply 11 in the canister 10. The base 13 is connected to an electric switch 15 connected to the power supply 11 in the canister 10. This electric switch 15 is comprised by a single-chip 16, N channeling MOST 17 (metal oxide semiconductor transistor) and a diode 18 connected in turn. The output pin of single-chip 16 is connected with the control pin of N channeling MOST 17. The output pin of the single-chip is the pin 1. The output pin of the single-chip is a pin 5. The control pin of the N channeling MOST is pin G. The output pin of N channeling MOST 17 connects with the positive pole 19 of the diode 18. The positive pole of the diode 18 connects with the negative pole of the illumination device 14. Furthermore, the negative pole of the diode 18 is serially connected with one discharge resistance 19 and an energy-saving discharge capacitance 20. The positive pole of the energy-saving discharge capacitance 20 connects with the output pin of the single-chip 16. It also is connected to a touch switch 21. One end of this touch switch 21 connects to an output pin 6 of the single-chip 16, and another end of this touch switch is grounded. Moreover, the output pin of the above described single-chip 16 connects to the pull-low resistance 22. One end of the resistance 22 connects with the output pin of the single-chip 16 and other end is grounded.

The single-chip 16, N channeling MOST 17, and diode 18 are fixed on a PCB 28. The PCB 28 is installed at the bottom of the base 13. A baffle 31 is connected with the base 13 and is set on the upper part of the PCB. In addition, through holes are made on the baffle 31. A spring 27 is connected with the electric switch 15 and stretches out the holes to connect with the negative pole of the power supply 11. The touch switch 21 is connected with the PCB 28.

The model of the single-chip 16 is preferably PIC12F508, and the model of the N channeling MOST 17 is preferably IRF7475. Two ends of the canister 10 are externally threaded. An internal wall of beam cover 12 and base 13 are internally threaded. The beam cover 12 connects to one end of the canister 10. The base 13 connects with another end of the canister.

The illuminating device 14 is composed of a lamp holder 23 and an illuminant 24 fixed upon the panel of the lamp holder 23. The reflecting cup 29 connects to the lamp holder 23 and the beam lens 30 is fixed on top of the reflecting cup 29. The bottom of the lamp holder 23 is positioned with the positive and negative pole 25, 26 connecting with the illuminant 24. The positive pole 25 of the illuminant 24 is connected with the positive pole of the power supply 11. The negative pole of the illuminant 24 connects with the electric switch 15 through the canister 10. The electric switch 15 is connected to the negative pole of the power supply 11 via the spring 27.

The electric switch 15 is installed at the bottom of the base 13 and positioned through a hole with the seal cover 32. This seal cover is made from elastic material. The touch switch can be operated by pressing the seal cover 32.

Basing on the electric switch 15 is fixed at the bottom of the base 13. The energy-saving discharge capacitance 20 can provide power to the electric switch 15. Users may press the seal cover 32 to operate the touch switch 21. By pressing the seal cover 32 once, the diode 18 can be powered on, which then illuminates the illuminant 24. When the user presses the seal cover 32 for a seconds to operate the touch switch 21, the single-chip switches over between high and low level. The N channeling MOST 17 transmits the touch signal to the control diode. The illuminant 24 may then flash continuously, thereby illuminating and transmitting a warning signal.

While the present invention is described herein with reference to illustrative embodiments for particular applications, it should be understood that the invention is not limited thereto. Those having ordinary skill in the art and access to the teachings provided herein will recognize additional modifications, applications, and embodiments, within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. An electrical torch or flashlight the electrical torch comprising:

a canister;

a power supply fixed in the canister;

a beam cover connected with one end of the canister and a base connected to a second opposite end of the canister;

wherein an illumination device is installed in the beam cover, the illumination device being connected with a positive pole of the power supply;

the base is connected to an electric switch, the electric switch being connected to the power supply, the electric switch having:

a single-chip, N channeling MOST (metal oxide semiconductor transistor) and a diode connected in turn;

an output pin of the single-chip is connected with a control pin of the N channeling MOST, the output pin of the N channeling MOST being connected with a positive pole of the diode, the diode being connected with a negative pole of the illumination device;

a negative pole of the diode is serially connected with a discharge resistance and energy-saving discharge capacitance;

a positive pole of the energy-saving discharge capacitance connecting with the output pin of the single-chip and to a one touch switch, an opposite end of the touch switch being grounded; and a pull-low resistance, one end of the pull-low resistance being connected to the output pin of the single-chip and an opposite end of the pull-low resistance being grounded.

2. The electrical torch of claim 1, wherein the illumination device includes:

a lamp holder;

an illuminant fixed upon the lamp holder panel;

a reflecting cup and beam lens fixed at a top of the reflection cup;

wherein a positive and negative pole is connected to the illuminant and positioned on a base of the lamp holder, the positive pole of the illuminant is connected with a positive pole of the power supply and a negative pole of the illuminant is connected with the electric switch via the canister, the electric switch being connected to the negative pole of the power supply.

3. The electric torch of claim 1 wherein the electric switch is fixed at a bottom of the base through a hole with a seal cover positioned at the bottom of the base.

* * * * *